US008253574B2

(12) United States Patent
Li et al.

(10) Patent No.: US 8,253,574 B2
(45) Date of Patent: Aug. 28, 2012

(54) SYSTEMS AND METHODS TO PREDICT FIRE AND SMOKE PROPAGATION

(75) Inventors: Qing Li, Shanghai (CN); Thomas A. Plocher, Hugo, MN (US)

(73) Assignee: Honeywell International Inc., Morristown, NJ (US)

( * ) Notice: Subject to any disclaimer, the term of this patent is extended or adjusted under 35 U.S.C. 154(b) by 970 days.

(21) Appl. No.: 11/618,339

(22) Filed: Dec. 29, 2006

(65) Prior Publication Data

US 2008/0157984 A1 Jul. 3, 2008

(51) Int. Cl.
*G08B 17/00* (2006.01)
*G08B 17/10* (2006.01)

(52) U.S. Cl. ..... 340/584; 340/628

(58) Field of Classification Search ..... 340/702, 340/628, 584; 720/3–22
See application file for complete search history.

(56) References Cited

U.S. PATENT DOCUMENTS

| | | | | |
|---|---|---|---|---|
| 5,648,914 | A * | 7/1997 | Bauer et al. | 702/19 |
| 6,496,110 | B2 * | 12/2002 | Peterson et al. | 340/522 |
| 6,507,281 | B2 * | 1/2003 | Magerle et al. | 340/584 |
| 2002/0053978 | A1 * | 5/2002 | Peterson et al. | 340/573.1 |
| 2002/0102969 | A1 * | 8/2002 | Enns et al. | 455/414 |
| 2005/0006109 | A1 * | 1/2005 | McSheffrey et al. | 169/75 |
| 2005/0069207 | A1 * | 3/2005 | Zakrzewski et al. | 382/190 |
| 2008/0106437 | A1 * | 5/2008 | Zhang et al. | 340/945 |

OTHER PUBLICATIONS

W.W. Jones, R.D. Peacock, G.P. Forney, P.A. Reneke, NIST Special Pub. 1026, CFAST (Version 6) Technical Reference Guide, Gaithersburg, MD, Dec. 2005.

J.E. Floyd, S.P. Hunt, F.W. Williams, P.A. Tatem, A Network Fire Model for the Simulation of Fire Growth and Smoke Spread in Multiple Compartments with Complex Ventilation. J. of Fire Protection Eng. vol. 15, Aug. 2005, pp. 199-229.

J.E. Floyd, S.P. Hunt, F.W. Williams, P.A. Tatem, Fire and Smoke Simulator Version 1—Theory Manual. NRL/MR/6180—04-8765, Naval Research Lab, Washington DC, 2004.

W.S. Dols, G.N. Walton, CONTAMW 2.0 User Manual: Multizone Airflow and Contaminent Transport Analysis Software, NISTIR 6921, NIST Gaithersburg, MD, Nov. 2002.

B.D. Nichols, W.S. Gregory, Abstract of FIRAC User's Manual: A Computer Code to Simulate Fire Accidents in Nuclear Facilities, http://www.nea.fr/abs/html/nesc1092.html, 1986.

R. Gaunt, R. Cole, C. Erickson, R. Gido, R. Gasser, S. Rodriguez, M. Young, Executive Summary of MELCOR Code Manuals, http://melcor.sandia.gov/ExecutiveSummary.htm, 2000.

K. McGrattan, NIST Special Publication 1018, Fire Dynamics Simulator (Ver. 4) Technical Reference Guide, NIST Gaithersburg, MD, Sep. 2005.

W.D. Davis, G.P. Forney, NISTIR 6705, A Sensor-Driven Fire Model, Ver. 1.1, NIST Gaithersburg, MD, Jan. 2001.

Office Action for Chinese Application No. 200710307602.1 (6 pages) dated Aug. 11, 2010, with English translation.

* cited by examiner

*Primary Examiner* — Benjamin C Lee
*Assistant Examiner* — Cal Eustaquio
(74) *Attorney, Agent, or Firm* — Husch Blackwell LLP

(57) ABSTRACT

Systems and methods are provided for establishing smoke flow paths and times of flow between a plurality of ambient condition detectors. Such information can be used in establishing, in real time, dynamically changing evacuation flow routes.

20 Claims, 8 Drawing Sheets

SYSTEMS AND METHODS TO PREDICT FIRE AND SMOKE PROPAGATION

FIELD

The invention pertains to regional monitoring and alarm systems. More particularly, the invention pertains to such systems where evacuation routes are established for egress from the region being monitored.

BACKGROUND

Regional monitoring systems, such as fire detection/monitoring systems are very commonly required in multi-story buildings used for residential, business or commercial purposes. Such systems can provide information as to developing alarm conditions, such as developing fire conditions, on a given floor or region of a multi-story building. This information can be coupled to a fire alarm control panel or control unit which might be located in the lobby area so as to be readily accessible by first responders.

In addition to being able to detect and identify developing fire conditions it has been recognized that it is useful and helpful to provide individuals in the vicinity of such conditions with information as to evacuation routes, or the like so as to assist their departure from the vicinity of the alarm condition. It has also been found useful to provide flexible evacuation or escape routes through the use of adaptive evacuation systems which can respond dynamically to developing conditions.

Adaptive evacuation systems offer the potential to relieve the occupant of difficult emergency egress decisions. With knowledge of the location of fire and smoke hazards in the building, these systems could plan safe routes and communicate them to occupants. The basic adaptive evacuation system receives information from a fire panel about currently active smoke and heat detectors. Routes and exits in proximity to the active detectors are assumed to be unsafe and closed for use in evacuation. Evacuation planning is done with the remaining "safe" routes. Assessing the situation, predicting the progression of fire and smoke, and then identifying the paths unsafe for evacuation are important steps in adaptive evacuation systems.

A process or method would be useful to predict the fire and smoke propagation paths, which could then be sent as input to the evacuation route planning algorithm. Smoke propagation methodology is complicated by severe limitations in processing capability and speed of the typical fire control panels. This restricts the use of high fidelity smoke propagation models. An efficient approach to smoke spread prediction that requires small amounts of real time computation by available fire control panels would be beneficial.

BRIEF DESCRIPTION OF THE DRAWINGS

FIG. 6 a variation of the flow diagram of FIG. 4 taking into account real time sensor or detector output indicia or readings of smoke concentration temperature and the like;

DETAILED DESCRIPTION

Figure 1:
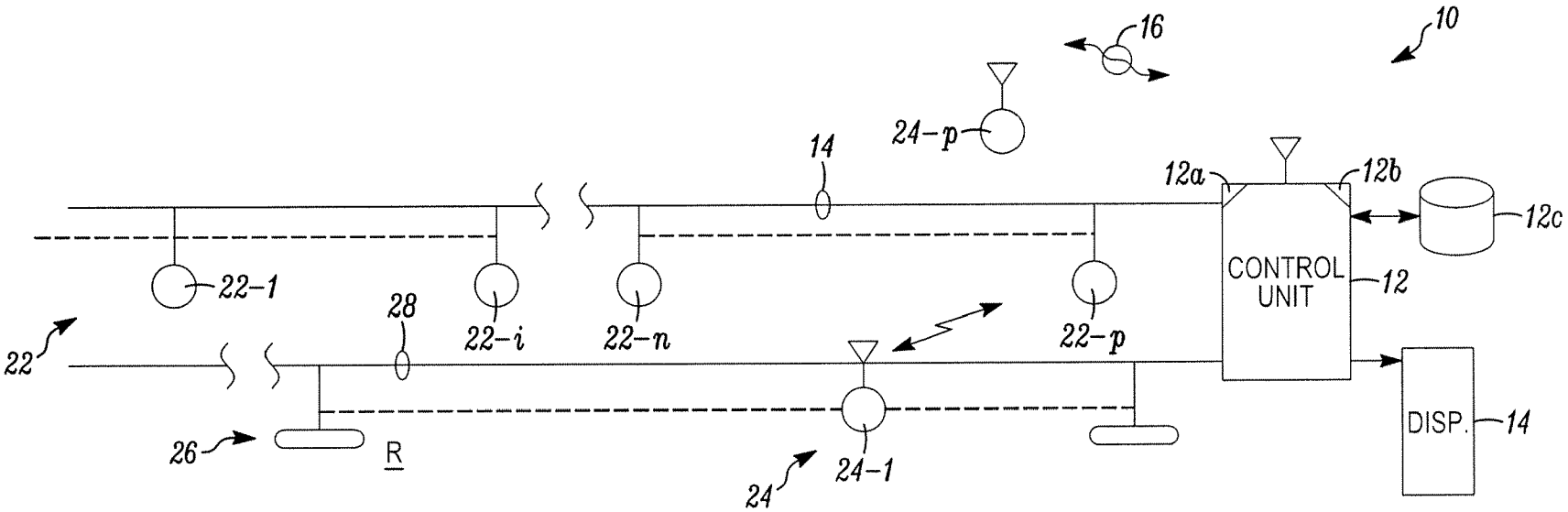
FIG. 1 is an overall view of a system which embodies the present invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

In a first method that embodies the invention, locations of each detector and typical smoke spread times between each adjacent pair of detectors are stored. Typical smoke spread time between adjacent detectors is estimated by an offline smoke propagation model, or by historical data or experiments. Almost all processing can be carried out in advance and offline. Propagation times can then be stored at the alarm control unit. When a detector is activated due to fire or smoke, the smoke propagation paths and detector activation time sequences are retrieved from storage and used. Because the propagation information is pre-built, stored and retrieved, it adds little computation load to the alarm control circuitry and processor(s) for smoke propagation prediction.

In an alternate embodiment, the methodology and data needed to predict smoke propagation times between adjacent detectors or compartments can be stored. The smoke propagation paths can then be predicted based on real time data. Real-time smoke propagation prediction processing which involves only a small number of compartments can be carried out. This method requires much less computational load than known building fire/smoke models which usually involve all compartments in each iteration.

Thus, in the first method, almost all smoke propagation path predictions are pre-computed and stored in a database at the fire control panel before being put in use. The smoke propagation paths are retrieved from storage in real-time. Path processing adds almost no computational load on the fire control units, unlike known propagation processing which needs to use the computation power to solve known modeling equations. Such processing is almost always beyond the capability of known fire control units.

In the alternate method, smoke propagation is predicted among the active compartment structure. In this embodiment, only compartments containing activated detectors and their adjacent compartments, i.e., a small number of total compartments in most cases, especially at the initial stages of a fire are processed to determine propagation times. Therefore, it requires much less computational power than known propagation processing methods which require involving all compartments in each iteration when solving the set of simultaneous equations for the whole network or region all together at one time.

Nodes of the present processing are based on detectors rather than a room or other building compartments as in all prior art models. The real time data from the detectors can be used by the method to predict the smoke propagation between adjacent nodes, or detectors.

Results of the present processing can be visually displayed for use by first responders and/or stored locally in a disk drive/database. Results can also be input to adaptive evacuation path software to facilitate development of one or more evacuation paths or routes from the region. Such routes can be identified audibly or visually, or both in the relevant subregion being monitored.

FIG. 1 illustrates a system 10, an ambient condition monitoring system such as a fire alarm system, in accordance with the present invention. The system 10 is illustrated in FIG. 1 installed and monitoring region R.

The region R could include an interior space of a multistory building, having a plurality of floors. Alternately, system 10 could be installed in single floor region all without limitation.

System 10 incorporates an alarm control unit 12 which is in communication via a wired medium, such as 14 or a wireless medium, such as 16 with pluralities of detectors such as 20 and 22 which are installed throughout the region R as would be understood by those of skill in the art.

The pluralities of detectors 22, and 24 (plurality 22 being in wired communication via medium 14 with control unit 12 and plurality 24 being in wireless communication) sensing developing ambient conditions in the region R and could include smoke, fire or thermal sensors as would be understood by those of skill in the art. The selection of installation locations for these detectors would also be understood by those of skill in the art, usually, at least one detector in one compartment (room, stairwell, hallway, and the like). Each of the detectors 22, 24 which can be considered a node of the network of the system 10 is in communication with the control unit 12 and can forward status information as to one or more sensed ambient conditions in the immediate vicinity thereof.

Control unit 12 which could be implemented in part via one or more programmable processors 12*a* which can carry out or execute a variety of control programs or software 12*b*, prerecorded on a computer readable medium, responds to the signals or information received from the various detectors 22, 24 and can assess developing alarm conditions as also would be known to those of skill in the art. Further, without limitation, the control unit 12 may be in the vicinity of the region R but could also be displaced from the region R and in communication with the detectors 22, 24 via a computer network such as the Internet.

System 10 can include a storage unit and database software 12*c* which can be accessed by processor(s) 12*a* and control software 12*b*. The control software 12*b* could also include adaptive evacuation route or path determination software which responds to smoke path and transit time information as discussed below. Such information would be displayed for first responders and/or evacuees on a graphical display 14. Output devices 26, coupled to circuits 12 via medium 28 can provide audible and/or visual evacuation path information to persons in region R based on subsequently discussed methods.

Figure 2:
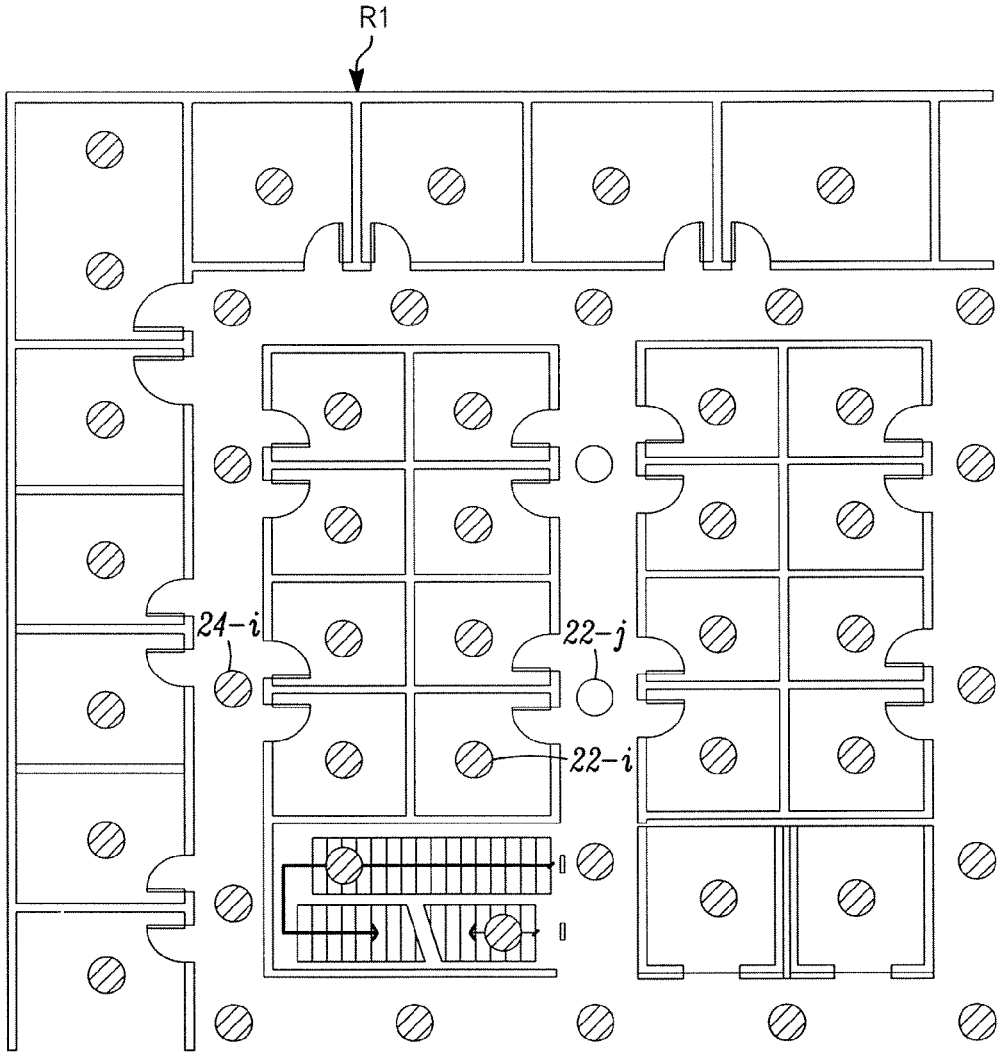
FIG. 2 is a portion of a floor plan of a region illustrating representative nodes or detectors.

FIG. 2 illustrates a floor plan R1 of the region R, exemplary only and not a limitation, in which the system 10 has been installed. The nodes or detectors 22-*i*. . . -*p* for example are distributed throughout the region, some of them being located in the subregion R1 of FIG. 2.

In one aspect of the invention, smoke propagation times between each pair of detectors, for example between 22-*i* and 22-*j* of FIG. 2 (detector 22-*i* is indicated as having gone into an alarm state) can be predetermined. This determination can be made offline using known offline smoke propagation models or historical data.

Figure 3:
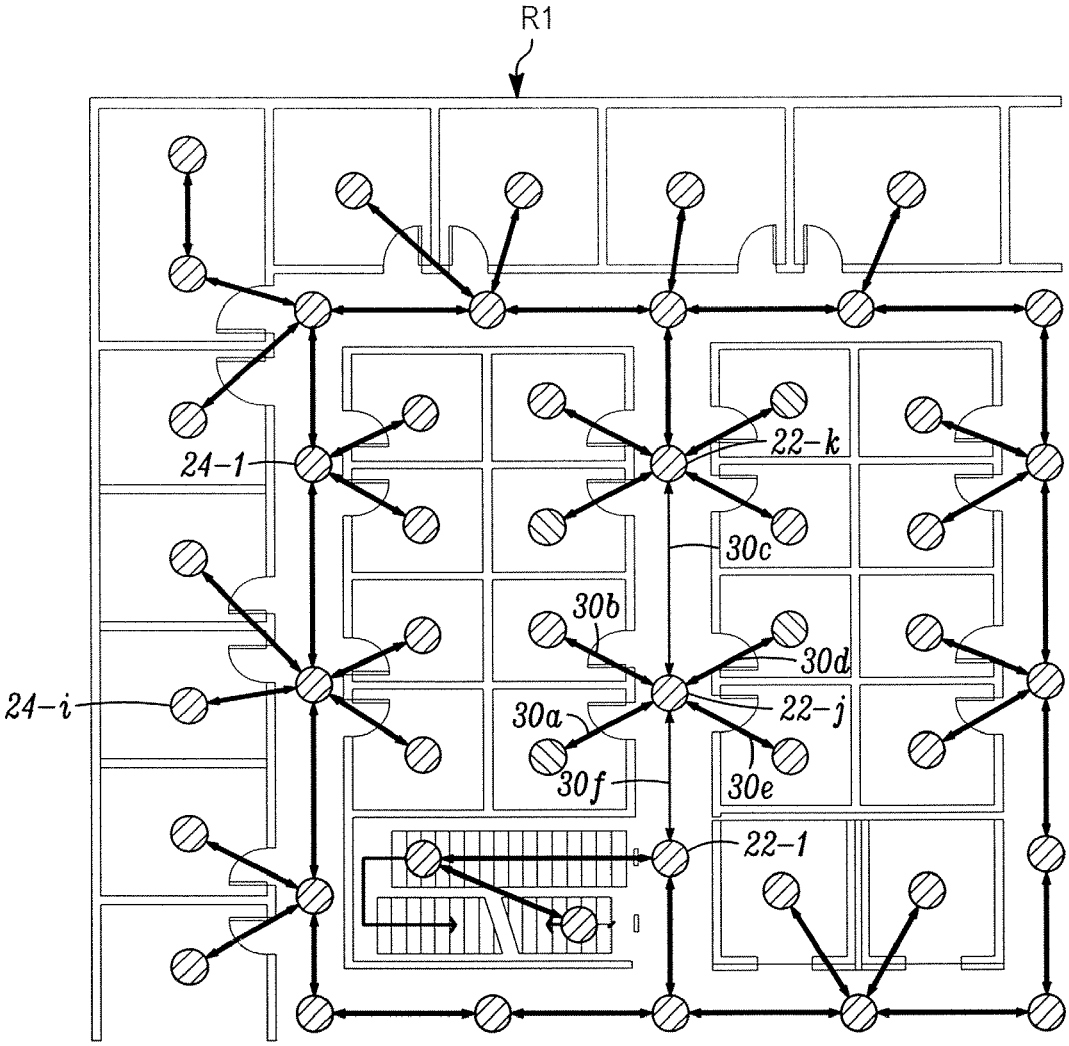
FIG. 3 corresponds to the region of FIG. 2 with various smoke paths illustrated.

FIG. 3 illustrates smoke propagation paths between pairs of detectors or nodes in the form of directed edges. For example, where detector or node 22-*i* has gone into alarm, smoke propagation paths or edges can be defined with detector 22-*j*, namely path 30*a*. Similarly, relative to detector 22-*j* a plurality of other smoke propagation paths 30*b, c, d, e, f* can be defined and smoke propagation transit times between node 22-*i* and 22-*k* could also be established if desired.

A process can thus be carried out identifying smoke propagation times between each pair of nodes or detectors, on an offline basis, and all such data stored, in database 12*c*, for later use and retrieval by for example control unit 12 or any other processor or control unit coupled thereto in the event that one of the detectors such as 22-*i* goes into alarm. Given the prestored nature of the smoke propagation times, there is little or no additional computational load imposed on control unit and circuits 12 in establishing paths and elapsed times of smoke flow from the detector 22-*i* into other portions of region R1.

Figure 4:
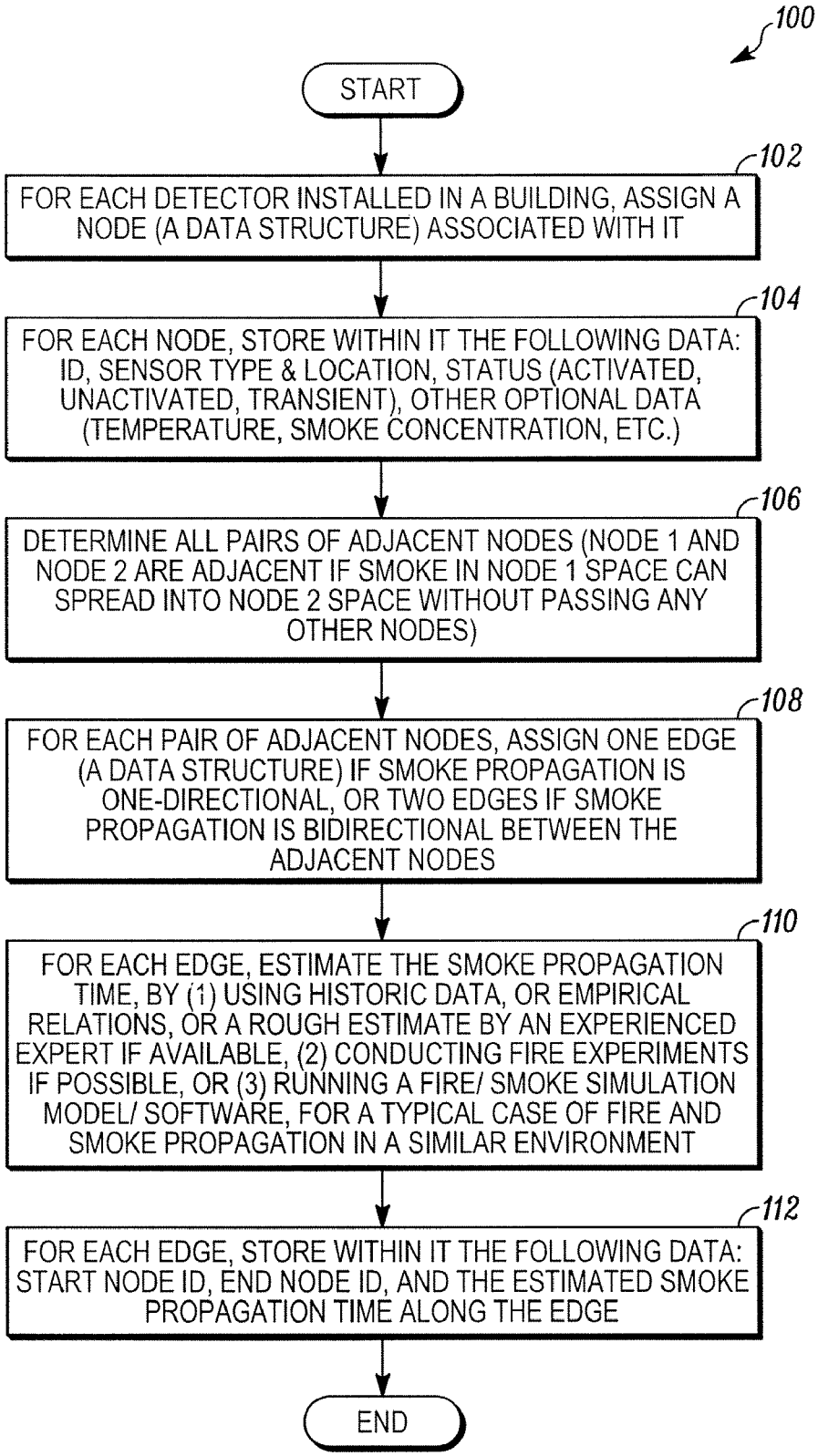
FIG. 4 is a flow diagram of processing to establish, offline, a plurality of nodes, edges, and smoke propagation times between nodes or detectors.

FIG. 4, a flow diagram, illustrates steps of a method 100 which can be implemented, on an offline basis, using for example by the processor 12*a* and executable software 12*b*, or any other processor without limitation relative to the various smoke paths of the region R.

Each detector located in the region R is associated with a node, a data structure which represents various characteristics thereof 102. For each node a plurality of information is stored including detector identification number, type, location, status and other related information 104. All pairs of adjacent nodes are determined (best seen in FIG. 3) 106.

For each pair of adjacent detectors or nodes, an edge can be assigned if smoke propagation is unidirectional. Two edges can be assigned if smoke propagation is bidirectional between the nodes, 108. For each of the edges, smoke propagation time between associated detectors is established or estimated, 110. Finally, data for each edge is stored in a database 12*c*, including identification of start node, end node as well as estimated smoke propagation time along the edge, 112.

Processing 100 establishes data defining nodes, edges, and smoke propagation times along all available paths in the region R. This information can be stored for example at the control unit 12 in disk drive or database 12*c* on a computer readable medium. The control unit 12 can then access that information directly or with processor(s) in communication with control unit 12.

It will also be understood that the details of the data structure in which that information is stored in the disk drive or database 12*c* are not limitations of the present invention.

Figure 5:
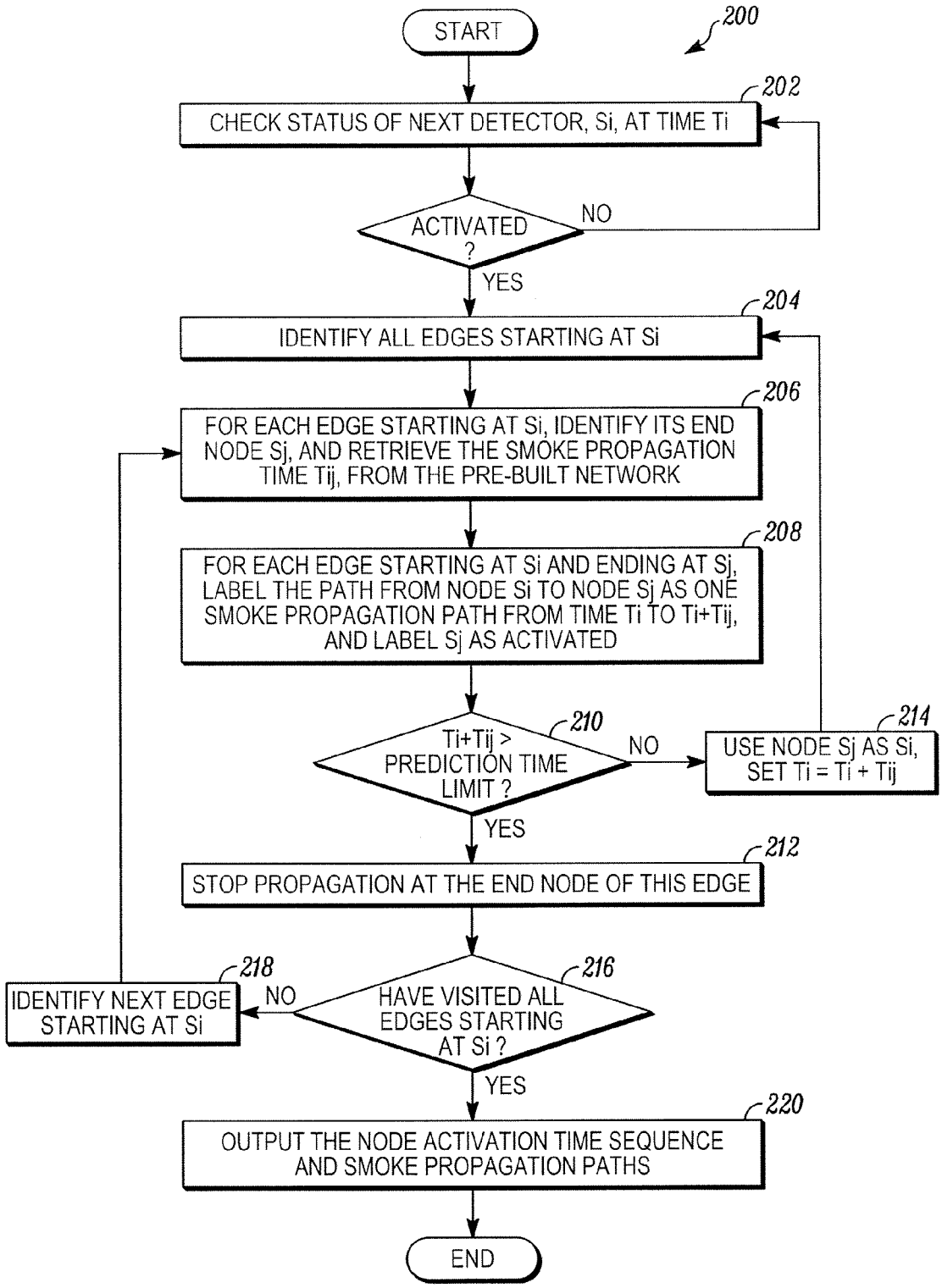
FIG. 5 is a flow diagram for predicting node or detector activation time sequences and smoke propagation paths based on information obtained from the data established by the flow diagram of FIG. 4.
Figure 6:
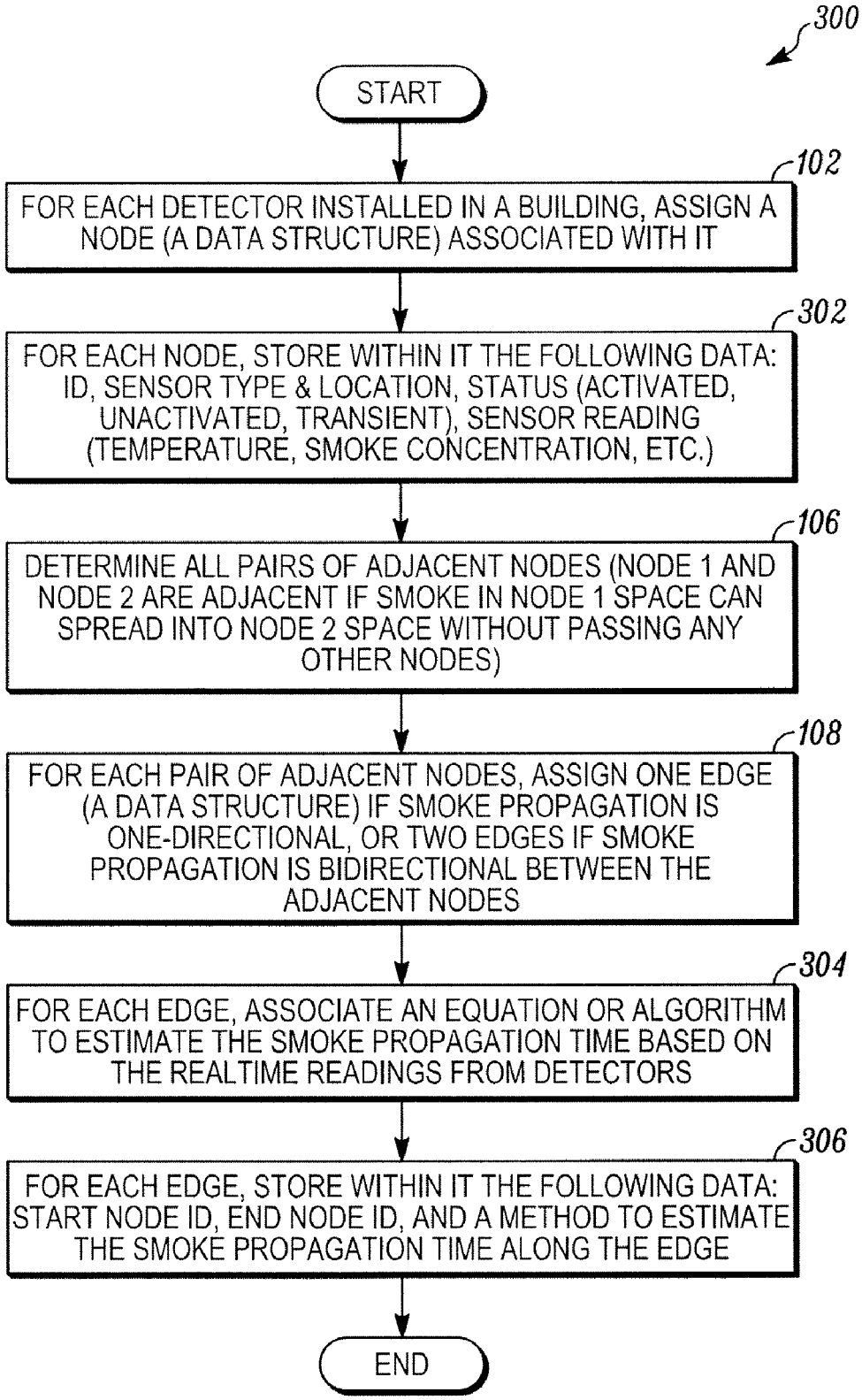
Figure 7:
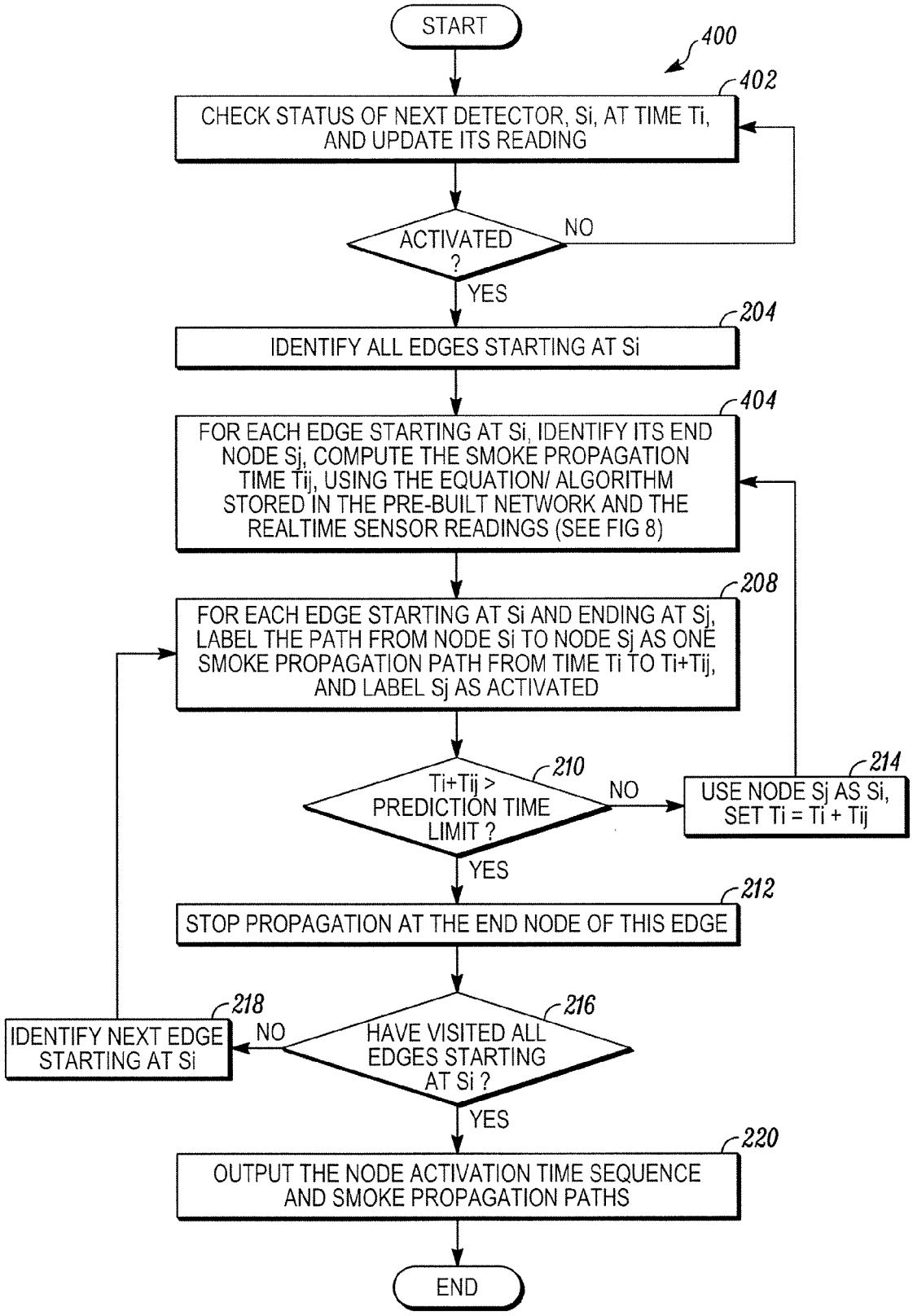
FIG. 7 is a flow diagram, a variation of the flow diagram of FIG. 5 wherein smoke propagation times are established dynamically in real time for active detectors or nodes as well as adjacent detectors or nodes.

Processing 200, FIG. 5, reflects one processing embodiment of system 10 in response to one or more of the detectors 22-*i*, 22-*i* having gone into an alarm state, as illustrated by detector or node 22-*i* of FIG. 3. It will also be understood that the methodology 200 could be carried out on a periodic basis and not necessarily in response to any given detector or node exhibiting an alarm state.

The status of the next detector Si is checked at time Ti, 202. If activated, all edges starting in Si are identified, 204. All such edges would have been pre-stored in disk drive and/or database 12*c* as discussed above relative to processing 100.

For each edge starting at Si, the end node Sj is identified. The smoke propagation time Tj can then be retrieved from exemplary disk drive database 12*c*, 206. For each edge starting at Si and ending at Sj, the path from node or detector Si to node or detector Sj is labeled as one smoke propagation path from time Ti to Ti+Tij. Detector Sj is designated as being activated, 208. The prediction time limit is compared to the sum of Ti+Tij, 210. If the prediction time limit is less, propagation ceases at the end node of this edge, 212. If not, node Sj replaces node Si and the time is reset, 214.

A determination is made subsequent to stopping propagation 212, as to whether all edges have been examined starting at Si, 216. If not, the next edge is identified starting at Si, 218. Otherwise, the node activation time sequence in smoke propagation paths are output, 220.

The output node activation time sequences and smoke propagation paths can then be made available for use by an adaptive evacuation system (software 12*b* for example) in responding to the developing fire condition and establishing safe routes for evacuation. That information could also be stored in one or more files in database 12*c* or presented visually 14.

Advantageously, as noted above, since processing 100 has been carried out on a non-real time, offline basis, such processing is unnecessary by the control unit 12 when an alarm condition has been detected at a particular node or detector. Thus processing 200 is able to establish smoke propagation paths and sensor activation time sequences promptly since the smoke propagation times between sensors have been pre-established and stored, for example in disk drive and database 12*c*.

The additional computational load required of control unit 12 to carry out the processing 200 in view of the pre-stored propagation paths and sensor activation time sequences can be expected to be limited or minimal. This is quite unlike known processes for predicting fire and smoke propagation paths which require substantial computational resources.

Unlike the processing 100, 200 discussed previously, alternate processing, discussed subsequently, can predict smoke propagation among a small number of active nodes or detectors as opposed to all nodes or detectors on a given floor or region at one time. This greatly reduces computational load.

Various elements of processing 300 are identical to those of processing 100 discussed previously and have been identified with the same identification numerals. Processing 100 includes element 302. For each node or detector sensor type and location as well as status and output indicium indicative of temperature, smoke concentration or the like are stored. Subsequent to executing element 108 of method 300, smoke propagation time is estimated for each edge based on real time readings or outputs from the respective detectors using a predetermined equation or process, 304. Subsequently, for each edge the start node identification, end node identification as well as the method to estimate smoke propagation time along the edge are stored, 306.

Those of skill in the art will understand that a variety of processes are available which can be used to estimate smoke propagation time along an edge. None of the details of those processes are limitations of the present invention.

Processing 400 illustrates the use of real time detector information in establishing smoke propagation paths and propagation time estimations based on that information associated with activated detectors or nodes. Various elements of processing 400 are identical to those previously discussed relative to processing 200 and have been given the same identification numerals. Initially, the status of the next detector Si at time Ti is determined and its current output indicium or value is obtained. Subsequently for each edge starting at detector or node Si the end node Sj is identified, the smoke propagation time is established or computed Tij using a preselected equation or processing in combination with real time sensor outputs but only for activated detectors, 404. Exemplary processing of smoke propagation time is illustrated subsequently in FIG. 8.

From smoke propagation paths, time sequences of sensor activations due to smoke propagation, and other related information can be forwarded to the evacuation route planning processor 220.

Figure 8:
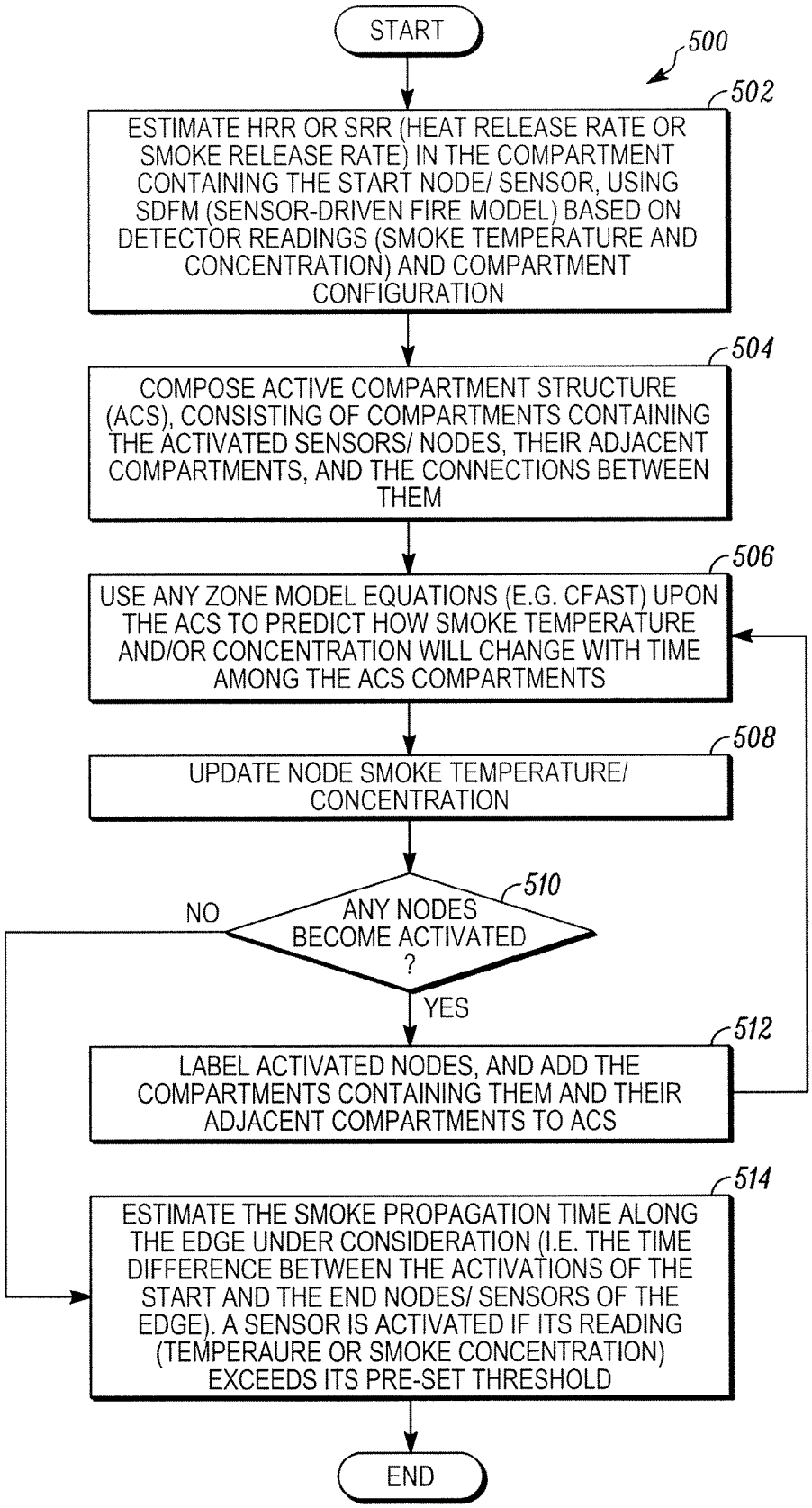
FIG. 8 illustrates exemplary smoke propagation time processing in response to real time signals or outputs from respective detectors or nodes.

FIG. 8 illustrates exemplary smoke propagation time determination processing 500. It will be understood that a variety of methods can be used to establish smoke propagation time between nodes without departing from the spirit and scope of the present invention. For example, an estimation of heat release rate or smoke release rate in the compartment containing the node or detector of interest can be determined using a sensor-driven fire model based on detector outputs and compartment configuration, 502. An active compartment structure can be composed including those compartments having activated detectors or nodes as well as their adjacent compartments and paths there between, 504. Known smoke propagation models can be used to predict how smoke, temperature and/or concentration will change with time among the various compartments, 506.

Node or detector signals indicative of temperature or smoke concentration for example can then be updated, 508. A determination is made, 510 as to whether any other nodes or detectors are indicating an alarm condition and have become activated. If so, those activated nodes or detectors are identified and the compartments containing them and their adjacent compartments are added to the active compartment structure, 512. If not, an estimate of smoke propagation time along the edge under consideration can then be determined, 514.

Those of skill will understand that the sensor-driven fire model as well as the zone model equations can be implemented in a variety of configurations. The following are illustrative and representative equations only and are not limitations of the present invention.

Major equations of the Sensor-Driven Fire Model (SDFM):

$$Q_c = 0.172 H_1^{5/2}\left(\frac{r}{0.18H_1}\right)^{0.345}\left(\frac{\Delta T_{cj}^{3/2}}{T_\infty^{1/2}}\right)$$

and $$Q = \frac{Q_c}{(1-\chi_\gamma)}$$

where $Q_c$ is the convective heat release rate, kW; Q is the total heat release rate, kW; $H_1$ is the ceiling height above the fire surface, m; r is the radial distance from the plume centerline, m; ΔTcj is the excess ceiling jet temperature, K; and $T_\infty$ is the ambient temperature, K; $\chi_r$ is the radiative fraction of the fuel.

More details are available in, W. D. Davis and G. P. Formey, NISTIR 6705, A Sensor-Driven Fire Model, Version 1.1, National Institute of Standards and Technology, Gaithersburg, Md., January 2001.

Major equations of the Consolidated Model of Fire Growth and Smoke Transport (CFAST):

TABLE 1

Conservative zone model equations

| Equation Type | Differential Equation |
|---|---|
| i'th layer mass | $\frac{dm_i}{dt} = \dot{m}_i$ |
| pressure | $\frac{dP}{dt} = \frac{\gamma-1}{V}(\dot{h}_L + \dot{h}_U)$ |
| i'th layer energy | $\frac{dE_i}{dt} = \frac{1}{\gamma}\left(\dot{h}_i + V_i\frac{dP}{dt}\right)$ |
| i'th layer volume | $\frac{dV_i}{dt} = \frac{1}{\gamma P}\left((\gamma-1)\dot{h}_i - V_i\frac{dP}{dt}\right)$ |

TABLE 1-continued

| Conservative zone model equations | |
|---|---|
| Equation Type | Differential Equation |
| i'th layer density | $\frac{d\rho_i}{dt} = -\frac{1}{c_p T_i V_i}\left((\dot{h}_i - c_p \dot{m}_i T_i) - \frac{V_i}{\gamma - 1}\frac{dP}{dt}\right)$ |
| i'th layer temperature | $\frac{dT_i}{dt} = -\frac{1}{c_p \rho_i V_i}\left((\dot{h}_i - c_p \dot{m}_i T_i) + V_i \frac{dP}{dt}\right)$ |
| | $\frac{dE_i}{dt} + P\frac{dV_i}{dt} = \dot{h}_i$ |
| | $\rho_i = \frac{m_i}{V_i}$ (density) |
| | $E_i = c_v m_i T_i$ (internal energy) |
| | $P = R\rho_i T_i$ (ideal gas law) |
| | $V = V_L + V_U$ (total volume) |

where $m_i$ is the total mass in layer i, kg; subscript i represents one zone of a zone model, for example, an upper smoke layer zone (U), or a lower cool air layer zone (L) in a two-zone model as a CFAST model; P is pressure, Pa; $c_p$ is heat capacities of air at constant pressure, J/(kgK); $c_v$ is heat capacities of air at constant volume, J/(kgK); γ is ratio of heat capacities of air at constant pressure ($c_p$) and constant volume ($c_v$); V is volume, $m^3$; h is enthalpy, J/kg; E is internal energy, J/kg; p is air density, $kg/m^3$; R is universal gas constant, J/(kgK).

More details are available in, W. W. Jones, R. D. Peacock, G. P. Formey, P. A. Reneke, NIST Special Publication 1026, CFAST-Consolidated Model of Fire Growth and Smoke Transport (Version 6) Technical Reference Guide, Gaithersburg, Md., December 2005.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

For the case of two or more detectors being detected as activated in a building, each detector activation will initiate, by processing 200 or 400, a prediction of smoke propagation paths and time sequences of future activations of other detectors. The multiple predictions originated from different detectors can be combined into one prediction by various methods. One example of the combining methods is that the combined smoke propagation paths consist of all paths that appear in at least one of the multiple predictions mentioned above, and the activation time of a detector along the paths after combination takes the value of the earliest of the activation times of the same detector along the paths in the multiple predictions originated from activations of different detectors.

The invention claimed is:

1. A method of predicting smoke propagation comprising:

establishing a plurality of ambient condition detectors in a region, assigning each detector a node;

establishing select reference smoke flow paths between selected pairs of detectors based on their physical location and structural environment, wherein the step of establishing select reference smoke flow paths includes selecting pairs of nodes wherein smoke can travel from one node of said pair to the other node of said pair without passing any other nodes and with regard to their physical location and structural environment, assigning to each pair of selected nodes one edge if smoke propagation between said pair is unidirectional and two edges if smoke propagation between said pair is bidirectional, estimating smoke propagation time along each edge based on the physical location and structural environment;

establishing a database of at least detector specific information and related reference smoke flow paths between detectors and related time based smoke flow values or a predetermined method to calculate related time based flow values between detectors, wherein establishing the database includes storing for each edge, start node identification, end node identification and estimated smoke propagation time along the edge;

sensing a developing ambient condition at a respective detector and, in real-time, retrieving the detector specific information and reference smoke flow paths associated with the respective detector;

establishing, in real-time, at least one time based smoke flow value for at least one reference smoke flow path for the respective detector;

establishing a plurality of predictive smoke detector to smoke detector propagation paths, combined from multiple predictions of smoke detector to smoke detector smoke flow paths and times originated from two or more activated detectors based on the established reference smoke flow paths, wherein the predictive smoke detector to smoke detector propagation paths are established between each of the two or more activated detectors and all adjacent nodes in which possible paths are likely to occur; and outputting at least smoke path information of the two or more activated detectors and adjacent nodes and respective time based smoke flow values based on said predictive smoke detector to smoke detector propagation paths.

2. A method as in claim 1 where establishing, in real-time, time based smoke flow includes establishing time based smoke flow values for a plurality of smoke detector to smoke detector smoke paths starting at the respective detector.

3. A method as in claim 1 where establishing, in real-time, the plurality of time based smoke flow values includes at least one of, retrieving a respective pre-stored flow value between the respective detector, and, another selected detector, or, carrying out a predetermined method to calculate a time based flow value between the respective detector and the other selected detector.

4. A method as in claim 3 where retrieving includes retrieving a plurality of pre-stored time based flow values starting from the respective detector and the other detector.

5. A method as in claim 3 where carrying out includes calculating a selected plurality of time based flow values, starting at the respective detector and extending through a plurality of other detectors.

6. A method as in claim 1 where outputting includes at least one of storing the smoke path information and time based smoke flow values in a computer readable medium, visually displaying the smoke path information and time based smoke flow values, or, using the smoke path information and time based smoke flow values in establishing at least one regional evacuation route.

7. A method as in claim 6 where the at least one regional evacuation route presented is at least in part by one of an audio presentation, or, a visual presentation.

8. A method as in claim 1 which includes pre-establishing and storing intra-location time based smoke flow information in a computer readable medium.

9. A method as in claim 1 which includes generating a time sequence of regional evacuation routes in response to output smoke path information and flow values.

10. A method as in claim 9 which includes at least one of audibly or visually providing evacuation route information in the respective region.

11. A system comprising:

a plurality of ambient condition detectors, each detector assigned a node;

a control element coupled to the detectors, the control element containing a plurality of pre-stored reference smoke flow patterns between the detectors based on their physical location and structural environment , said control element containing a plurality of pre-stored smoke propagation times, the control element responsive to condition indicating indicia from at least one of the detectors, the control element retrieves at least one pre-stored reference smoke flow pattern establishes at least one smoke flow time interval along at least a portion of the pattern and displays the portion of the pattern and time intervals; and wherein each of said pre-stored smoke flow patterns and propagation times comprises at least a first node paired to a second node wherein smoke can travel from said first node to said second node based on their physical location and structural environment without passing any other nodes, an edge assigned to said first and second node if smoke propagation is unidirectional and two edges assigned to said first and second node if smoke propagation is bidirectional, a smoke propagation time assigned to each edge, and wherein stored for each edge in said control element is start node identification, end node identification and estimated smoke propagation time along the edge, and wherein the displayed smoke flow pattern that is responsive to the condition indicating indicia includes smoke flow between the at least one detector and all adjacent detectors based on their physical location and structural environment.

12. A system as in claim 11 which includes a graphical display device on which the control element visually presents projected smoke dispersion from the vicinity of a selected detector.

13. A system as in claim 11 which includes a database which includes a representation of the smoke flow pattern.

14. A system as in claim 13 which includes control software, executed by the element to, at least in part, evaluate the condition indicating indicia and responsive to a selected condition from at least one detector retrieve a smoke flow pattern which starts at that detector.

15. A system as in claim 14 where the control software, relative to the smoke flow pattern, establishes a smoke flow time interval between selected detectors by one of retrieving a pre-stored smoke flow time interval, or, calculating a corresponding smoke flow time interval between the selected detectors.

16. A system as in claim 15 which includes a computer readable storage unit coupled to the control element, and a plurality of time intervals for smoke flow between pairs of detectors stored in the unit.

17. A system as in claim 16 where the unit comprises one of a magnetic computer readable medium, or an optical computer readable medium.

18. A system as in claim 15 where the control software, responsive to the smoke flow pattern and associated flow time intervals generates at least one evacuation route.

19. A system as in claim 18 where the evacuation route is one of, displayed on a graphical display device, or, identified by visual and audio outputs.

20. A system as in claim 18 where the detectors are selected from a class which includes smoke detectors, thermal detectors, fire detectors and gas detectors.

* * * * *